United States Patent [19]

Petrovich

[11] 3,975,265

[45] Aug. 17, 1976

[54] FROTH FLOTATION METHOD FOR THE RECOVERY OF MINERALS BY MEANS OF TERNARY SULFONIUM NITRITES AND TERNARY STIBINE DINITRITES

[76] Inventor: Vojislav Petrovich, 1925 W. Schiller St., Chicago, Ill. 60622

[22] Filed: Apr. 23, 1975

[21] Appl. No.: 570,521

Related U.S. Application Data

[63] Continuation of Ser. No. 500,006, Aug. 26, 1974, abandoned, which is a continuation-in-part of Ser. No. 423,434, Dec. 20, 1973, abandoned, which is a continuation-in-part of Ser. No. 285,883, Sept. 12, 1972, abandoned.

[52] U.S. Cl. ..... 209/166

[51] Int. Cl.[2] ..... B03D 1/02

[58] Field of Search ..... 209/166, 167

[56] References Cited

UNITED STATES PATENTS

| | | | |
|---|---|---|---|
| 1,552,937 | 9/1925 | McAuthur | 209/166 |
| 2,084,413 | 6/1937 | Siers | 209/166 |
| 2,132,902 | 10/1938 | Leuber | 209/166 |
| 2,242,224 | 5/1941 | Bley | 209/166 X |
| 2,904,177 | 9/1959 | Michol | 209/167 X |
| 3,238,127 | 3/1966 | Sebba | 209/166 X |

FOREIGN PATENTS OR APPLICATIONS

| | | | |
|---|---|---|---|
| 186,760 | 10/1922 | United Kingdom | 209/167 |

*Primary Examiner*—Robert Ralper

[57] ABSTRACT

A froth flotation method for the recovery of copper, nickel, cobalt, oxide, silicate, sulfide, arsenide, and antimonide minerals from their ores over iron sulfides, silica and silicates, as well as for the recovery of silicate minerals of lithium, sodium, potassium, and caesium over silica and feromagnesian silicates, and for the recovery of potassium halides and sulfates over sodium and magnesium halides and sulfates, and for the recovery of barium and strontium sulfates and carbonates, which comprises; subjecting the comminuted ore of aforesaid metals and minerals to froth flotation process in the presence of nitrous acid and an effective amount of a combination of ternary sulfonium nitrite and ternary stibine dinitrite, and potassium, sodium, ammonium nitrite, calcium strontium, barium, and iron dinitrite; the indicated compounds provide selectivity and recovery of aforesaid metal and mineral values.

11 Claims, No Drawings

FROTH FLOTATION METHOD FOR THE RECOVERY OF MINERALS BY MEANS OF TERNARY SULFONIUM NITRITES AND TERNARY STIBINE DINITRITES

This invention is a continuation of application Ser. No. 500,006 now abandoned, filed Aug. 26, 1974, which in turn is a continuation-in-part of application Ser. No. 423,434 now abandoned filed Dec. 20, 1973, which in turn is a continuation-in-part of application Ser. No. 285,883 now abandoned, filed Sept. 12, 1972.

This invention relates to a new class of complexes of Werner's type in which unipositive and dipositive metals in their nitrite, dinitrite and trinitrite salts are replaced by their organic equivalents, the unipositive ternary sulfonium radical, and the dipositive ternary stibine radical. Both radicals form in combination with nitrous acid and metals at the mineral surface of said minerals undissociable complexes of triple nitrite type with frothing properties. The triple nitrites of this invention comprises the alkylhydroxyalkyl sulfonium, and alkylhydroxyalkyl stibine radicals. The aforesaid radicals represent two metals in the respective nitrite complexes wherein each of the two metals is a member of a different group of metals. For example one group of metals for which the aforesaid radicals would be substituted are the alkali metals, whereas another group would be the alkaline earth metals, and some weak dipositive cations such as $Ni^{++}$, $Co^{++}$, $Fe^{++}$, $Cu^{++}$, $Pb^{++}$. Thus the combination of aforesaid radicals and metals at the mineral surface yielding triple nitrite complexes, being so, the third metal in said triple nitrite complexes is the metal at the mineral surface.

Besides triple nitrite complexes which are the most stable and normal in such kind of nitrites, the only stable double nitrite is formed of potassium and cobalt, which is very stable. Despite of this fact the weight of the invention is put on the triple nitrite complexes. Many double nitrite salts exist but they are not stable, or not sufficient stable to serve in froth flotation. Thus, the stable double nitrite being feasible only with potassium and cobalt minerals, so either potassium cation which is fixed at the mineral surface combines with ternary stibine radical representing organic equivalent of cobalt cation, or cobalt cation which is fixed at the mineral surface combines with ternary sulfonium radical representing organic equivalent of potassium cation by means of nitrous acid radical as complexing anion.

The complexing ability of nitrite as acid radical of a very weak acid with the said metals in respective minerals depends upon the presence of coordinated alkali metals or earth alkali metals, which in the respective case of this invention the alkali metals are represented by ternary sulfonium unipositive cations, and the earth alkali metals are represented by ternary stibine dipositive cations. Thus ternary sulfonium radical with the shortest chain length of substituted hydrocarbon which exercises a strong alkaline reaction, may unite with nitrous acid radical to form stable non hydrolyzable nitrites. Analogously, the ternary stibine radical which exercises a less strong alkaline reaction, may unite with nitrous acid radical to form stable non hydrolyzable dinitrites. Both, ternary sulfonium nitrites and ternary stibine dinitrites readily combine with said metals at the mineral surface and nitrous acid to undissociable mineral-hydrocarbon complexes of triple nitrite type.

In triple nitrite complexes of said metals, the nature of complexing cations my be such that two different ternary sulfonium unipositive radicals yield stable undissociable complexes at the mineral surface as is the case in flotation of cobalt minerals in a combination of diethylethanolsulfonium nitrite and dibutylbutanolsulfonium nitrite, which represent organic equivalents of potassium and sodium cations. In case of applying ternary stibine dispositive radicals the nature of complexing cations may be such that two different ternary stibine dipositive radicals yield stable undissociable complexes at the mineral surface as is the case in flotation potassium silicates which is accomplished in a combination of diethylethanolstibine dinitrite and dihexanolhexylstibine dinitrite representing organic equivalents of calcium and nickel cations respectively. In most cases as the experience teaches the practicing of recovering of hereinafter said minerals from their ores by froth flotation process and the most satisfactory in many cases and the only way to recover certain minerals is by applying a combination of ternary sulfonium radical and ternary stibine radical.

In accordance with the invention one unipositive cation may be potassium, sodium, or ammonium, and one dipositive cation may be calcium, strontium, barium, copper, lead, nickel, or iron, in such cases only one organic cation is sufficient, i.e., either sulfonium unipositive cation or stibine dipositive cation. Such practice is satisfactory and cheaper, which is an appealing advantage. Potassium, sodium, ammonium calcium, strontium, and barium cations are added to the mineral slurry as nitrite, copper, nickel and iron cations are added to the mineral slurry as soluble salts, preferably as sulfates, in combination with barium dinitrite.

Because in triple nitrites three metals form the complex, which represents three groups of very alike cations, many substitutions are possible. Namely, in triple nitrite of the composition $$K_2PbCu(NO_2)_6$$

each of the involved metal may be replaced 1. copper by metals: iron, nickel, and cobalt;
2. lead by metals: calcium, strontium, and barium;
3. potassium by metals: ammonium, rubidium, and caesium;

The organic equivalents of aforesaid complexes are as follows:

Lead-di(-dimethylethylsulfonium-dipropylpropanol-stibine)hexanitrite
Copper-di(-dimethylethylsulfonium-dihexylhexanol-stibine)hexanitrite
Nickel-di(-trimethylsulfonium-dipropylbutanol-stibine)hexanitrite
Cobalt-di(-dimethylethylsulfonium-dipropylpropanol-sulfonium)hexanitrite
Lithium-di(-dimethylethylsulfonium,-dioctyloctanol-stibine)hexanitrite
Sodium-di(-trimethylsulfonium-dioctanoloctylstibine)-hexanitrite
Potassium-di(-tripropylstibine-diheptanolheptyl-stibine)hexanitrite
Caesium-di(-triethylstibine-dihexanolhexylstibine)hexanitrite
Strontium-di(-triethylsulfonium-dihexylhexanol-stibine)hexanitrite
Barium-di(-trimethylsulfonium-dihexylhexanol-stibine)hexanitrite The variations of the number of hydroxyl groups in said ternary compounds as well as in complexes is based on the difference of alkalinity as well as of the different length of alkyl chains in the same. Thus, high alkaline and short chain ternary sulfonium or ternary stibine radicals preferrably have not any hydroxyl group, while the longer chain and less alkaline have one, two, or three hydroxyl groups, for minimum one hydroxyl in each complex must be present.

These replacements do not change, or change very little the stability of complexes and their insolubility.

Thus this invention relates to a new froth flotation method for the recovery of minerals containing lithium, sodium, potassium, caesium, strontium, barium, copper, nickel, and cobalt with a combination of nitrous acid, ternary sulfonium nitrites and ternary stibine dinitrites, or a combination of either sulfonium nitrite and one of aforesaid metal cations, or stibine dinitrite and one of aforesaid metal cations.

Ternary sulfonium nitrites and ternary stibine dinitrites are particularly adapted for the use in highly selective froth flotation processes for recovering of oxide, silicate, sulfide, arsenide, and antimonide minerals of copper, nickel, and cobalt. The method is well adapted to silicates of lithium, sodium, potassium, and caesium, such as feldspar minerals, and particularly for recovering sodium feldspar albite, and potassium feldspars orthoclose and microcline, furthermore potassium mica, lithium mica, as well as potassium halides and sulfates, and particularly for alunite hydrous potassium aluminium sulfate. Furthermore, for barium minerals such as barytes, and witherite, and strontium minerals such as strontianite and celestine.

Complexes of double and triple nitrites with ternary sulfonium unipositive cations and ternary stibine dipositive cations yield polarly oriented non-hydrolyzable and undissociable complexes capable of forming bubbles or attaching to the bubbles of the froth provided by agitation of the pulp of mineral slurry. The said ternary sulfonium and ternary stibine radicals possess collecting as well as some frothing properties which simplify the froth flotation process, which is obviously an advantage.

THE PREFERRED EMBODIMENTS

The preferred embodiments of collectors are of the following generic formulas:

for the sulfonium series

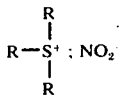

for the stibine series

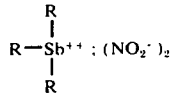

wherein R may be of the same constitution or to be of different constitution. Thus, R may be alkyl, primary alcohol, or polyhydroxyalkyl such as alkyldiol or alkyltriol. Said alkyl compounds have from 1 to 8 carbon atoms, and 0 to 3 hydroxyl groups. Thus ternary sulfonium and ternary stibine radicals comprise: trialkanol-, monoalkyldialkanol-, dialkylmonoalkanol-, trialkylsulfonium or stibine radicals respectively. The number of hydroxyl groups for the entire complex is from 1 to 3. The aforesaid radicals, i.e., sulfonium radical represents alkali metals and ammonia, whereas stibine radical represents earth alkali metals, and the group of weak basic dipositive cations such as $Ni^{++}$, $Co^{++}$, $Fe^{++}$, $Cu^{++}$, $Pb^{++}$.

The combination of either two different ternary sulfonium nitrites or two different stibine dinitrites, or one ternary sulfonium nitrite and one ternary stibine dinitrite yield equally satisfactory results in recovering of aforesaid minerals from their ores in respective cases.

In accordance with the invention one unipositive cation may be potassium, sodium, or ammonium, and one dipositive cation may be calcium, strontium, barium, copper, nickel, and iron. In such cases only one organic cation is sufficient, i.e., either ternary sulfonium unipositive cation or ternary stibine dipositive cation. All of possible and usefull combinations yield equally satisfactory results in recovering of aforesaid minerals from their ores.

SUMMARY OF THE INVENTION

The principal objective of this invention is to provide a new method of froth flotation practice.

A further objective of this invention is to provide froth flotation agents with collecting and frothing properties for collecting copper, nickel, and cobalt, oxide, silicate, sulfide, arsenide, and antimonide minerals from their ores, furthermore, aluminosilicates of lithium, sodium, potassium, and caesium, potassium halides and sulfates minerals, strontium, and barium carbonates and sulfates from their ores. In accordance with said objectives and to the best of this applicant's knowledge the said objectives have not been accomplished in the past. Furthermore, the applicant has discovered that most gangue minerals are anaffected by collectors of this invention. Hence a method for obtaining a highly selective concentration of metal or mineral values of aforesaid minerals from their ores in froth concentrates is provided.

The froth flotation of aforesaid minerals from their ores by serving with the present invention is carried out in accordance with good flotation practice and usually, though not always, involves flotation in rougher cells, followed by one or several cleanings of the rougher concentrate. The reagents are effective in small amounts and the promotion is sufficiently persistent so that it is possible to carry out rougher and cleaner flotation with a single addition of the reagents at the beginning of the operation. On the other hand, it is sometimes advantageous to use stage addition of reagents. Pulp densities are in general the same as in other applications of froth flotation practice, i.e., about 15 to 30 percent of solids by weight.

The above discussion as well as the disclosure illustrates my invention in a broad and general way; for a detailed illustration thereof the examples of the preferred embodiments are set forth below.

The procedure in performing the laboratory examples was of the same manipulation as follows:

The flotation test for the recovery of copper ores

The flotation tests were accomplished with sized samples passing 120 mesh sieve, in a 50 grams flotation cell with so grams of a copper ore mixed of chalcopyrite and covelline and predominantly pyrite in Examples 1 and 2, and a copper ore mixed of chrysocolla and malachite in gangue material composed of iron oxide, some pyrite, quartz, and calcium carbonate in Examples 3 and 4. The reagents were added dropwise. These flotation tests gave froth concentrates in which the recovery was estimated by microscopic count.

| Example | Collectors used | Auxiliary agents | recovery copper percent |
|---|---|---|---|
| 1 | Trimethylsulfonium nitrite<br>Dipentanolpentylstibine dinitrite | Nitrous acid | 91 |
| 2 | Dipentanolpentylstibine dinitrite | Potassium nitrite<br>nitrous acid | 90 |
| 3 | Trimethylsulfonium nitrite<br>Dipentanolpentylstibine dinitrite | Nitrous acid | 92 |
| 4 | Trimethylmethanolsulfonium nitrite | $FeSO_4$, $Ba(NO_2)_2$<br>nitrous acid | 88 |

The flotation tests for the recovery of nickel ores.

The flotation tests were accomplished with sized samples passing 120 mesh sieve, in a 50 grams flotation cell with 10 grams of a mixture of ullmannite and chloanthite, and 40 grams of a mixture of sulfide minerals such as pyrite and galena. The reagents were added dropwise. These flotation tests gave froth concentrate in which the recovery was estimated by microscopic count.

| Example | Collectors used | Auxiliary agents | Nickel recovery percent |
|---|---|---|---|
| 5 | Diethylethanolsulfonium nitrite<br>Diethylethanolstibine dinitrite | Nitrous acid | 88 |
| 6 | Diethylethanolsulfonium nitrite | Barium dinitrite<br>nitrous acid | 85 |
| 7 | Diethylethanolstibine dinitrite | Potassium nitrite<br>nitrous acid | 83 |

The flotation tests for the recovery of cobalt minerals

The flotation tests were accomplished with sized samples passing 120 mesh sieve in a 50 grams flotation cell with 10 grams of a mixture of cobaltite and smaltite, and 40 grams of a mixture of iron, lead. zinc, and copper sulfides. The reagents were added dropwise. These flotation tests gave concentrates in which the recovery was estimated by microscopic count.

| Example | Collectors used | Auxiliary agents | Cobalt recovery percent |
|---|---|---|---|
| 8 | Triethylsulfonium nitrite<br>Dibutylbutanolsulfonium nitrite | Nitrous acid | 87 |
| 9 | Dibutylbutanolsulfonium nitrite | Potassium nitrite<br>nitrous acid | 83 |

The flotation tests for the recovery of lepidolite, lithium mica

The flotation tests were accomplished with sized samples passing 100 mesh sieve, in a 50 grams flotation cell with 5 grams of lepidolite and 45 grams of a mixture of orthoclase and microcline. The reagents were added dropwise. These flotation tests gave froth concentrates in which the recovery was estimated by microscopic count.

| Example | Collector used | Auxiliary agents | Lepidolite recovery percent |
|---|---|---|---|
| 10 | Triethylsulfonium nitrite<br>Dioctanoloctylstibine dinitrite | Nitrous acid | 93 |
| 11 | Dioctanoloctylstibine dinitrite | Potassium nitrite<br>nitrous acid | 90 |
| 12 | Diethylethanolsulfonium nitrite | $FeSO_4$, $Ba(NO_2)_2$<br>nitrous acid | 87 |

The flotation tests for the recovery of albite, sodium feldspar

The flotation tests were accomplished with sized samples passing 100 mesh sieve, in a 50 grams flotation cell with 25 grams of albite, and 25 grams of a mixture of quartz, mica, sericite and orthoclase. The reagents were added dropwise. These flotation tests gave concentrates in which the recovery was estimated by microscopic count.

| Example | Collectors used | Auxiliary agents | Albite recovery percent |
|---|---|---|---|
| 13 | Diethylethanolsulfonium nitrite<br>Dioctyloctanolstibine dinitrite | Nitrous acid | 94 |
| 14 | Diethylethanolsulfonium nitrite | $FeSO_4$, $Ba(NO_2)_2$<br>nitrous acid | 92 |
| 15 | Dioctyloctanolstibine dinitrite | Potassium nitrite<br>nitrous acid | 94 |

The flotation tests for the recovery of orthoclase, potassium feldspar

The flotation tests were accomplished with sized samples passing 100 mesh sieve in a 50 grams flotation cell with 25 grams of orthoclase and 25 grams of a mixture of quartz, biotite, and plagioclase. The reagents were added dropwise. These flotation tests gave froth concentrates in which the recovery was estimated by microscopic count.

| Example | Collectors used | Auxiliary agents | orthoclase recovery percent |
|---|---|---|---|
| 16 | Dipropylpropanolstibine dinitrite<br>Dihexylhexanolstibine dinitrite | Nitrous acid | 93 |
| 17 | Dipropylpropanolstibine dinitrite | $FeSO_4$, $Ba(NO_2)_2$<br>nitrous acid | 90 |
| 18 | Dihexylhexanolstibine dinitrite | Calcium dinitrite<br>nitrous acid | 91 |

The flotation tests for the recovery of pollucite, caesium-sodium feldspar

The flotation tests were accomplished with sized samples passing 100 mesh sieve in a 50 grams flotation cell with 5 grams of pollucite and 45 grams of orthoclase and microcline. The reagents were added dropwise. These flotation tests gave froth concentrates in which the recovery was estimated by microscopic count.

| Example | Collectors used | Auxiliary agents | Pollucite recovery percent |
|---|---|---|---|
| 22 | Dipropylpropanolstibine dinitrite<br>Dihexylhexanolstibine dinitrite | Nitrous acid | 87 |
| 23 | Dipropylpropanolstibine dinitrite | $FeSO_4$, $Ba(NO_2)_2$<br>nitrous acid | 85 |
| 24 | Dihexylhexanolstibine dinitrite | Barium dinitrite<br>nitrous acid | 85 |

The flotation tests for the recovery of sylvine, potassium halide

The flotation tests were accomplished with sized samples passing 48 mesh sieve, in a 50 grams flotation cell with 25 grams of sylvine and 25 grams of sodium halide in a saturated brine. The reagents were added dropwise. These froth flotation tests gave froth concentrates in which the recovery was accomplished by chemical analysis.

| Example | Collectors used | Auxiliary agents | Sylvine recovery percent |
|---|---|---|---|
| 19 | Dipropylpropanolsulfonium nitrite<br>Dioctyloctanolstibine dinitrite | Nitrous acid | 90 |
| 20 | Dipropylpropanolsulfonium nitrite | $FeSO_4$, $Ba(NO_2)_2$<br>nitrous acid | 88 |
| 21 | Dioctyloctanolstibine dinitrite | Sodium nitrite<br>nitrous acid | 87 |

The flotation tests for the recovery of celestine, Strontium sulfate

The flotation tests were accomplished with sized samples passing 100 mesh sieve in a 50 grams flotation cell with 50 grams of celestine ore mixed with carbonaceous schist. The reagents were added dropwise. These flotation tests gave froth concentrates in which the recovery was estimated by microscopic count.

| Example | Collectors used | Auxiliary agents | Celestine recovery percent |
|---|---|---|---|
| 25 | Dimethylmethanolsulfonium nitrite Dihexylhexanolstibine dinitrite | Nitrous acid | 94 |
| 26 | Dihexylhexanolstibine dinitrite | Potassium nitrite nitrous acid | 90 |
| 27 | Dimethylmethanolsulfonium nitrite | $FeSO_4$, $Ba(NO_2)_2$ nitrous acid | 90 |

The flotation tests for the recovery of barytes, barium sulfate

The flotation tests were accomplished with sized samples passing 120 mesh sieve, in a 50 grams flotation cell with 50 grams barytes ore mixed with pyrite and schist. The reagents were added dropwise. These flotation tests gave froth concentrates in which the recovery was estimated by microscopic count.

| Example | Collectors used | Auxiliary agents | Barytes recovery percent |
|---|---|---|---|
| 28 | Dimethylpropanolsulfonium nitrite Dihexylhexanol stibine dinitrite | Nitrous acid | 94 |
| 29 | Dihexylhexanolstibine dinitrite | Potassium nitrite nitrous acid | 90 |
| 30 | Dimethylpropanolsulfonium nitrite | $FeSO_4$, $Ba(NO_2)_2$ nitrous acid | |

I claim:

1. A method of beneficiating ores selected from the group of oxide, silicate, sulfide, arsenide, and antimonide of copper, nickel, and cobalt, and minerals selected from the group consisting of lithium, sodium, potassium, and caesium silicates, halides and sulfates, barium, and strontium sulfates, and carbonates by froth flotation process to produce a froth concentrate of desired metal values which comprises; effecting froth flotation of said ores and minerals in the presence of nitrous acid and collectors consisting of a combination of ternary sulfonium nitrite and ternary stibine dinitrite, or a combination of two different ternary sulfonium nitrites, or a combination of two different ternary stibine dinitrites, or a combination of ternary sulfonium nitrite and either potassium, sodium, and ammonium nitrites, or calcium, strontium, barium, and iron dinitrites, or a combination of ternary stibine dinitrite and either potassium, sodium, and ammonium nitrites, or calcium, strontium, barium, and iron dinitrites, said compounds in conjunction with nitrous acid forming at the minerals surface of said metals mineral-hydrocarbon complexes; both components of said complexes have the formulas

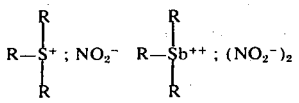

in which R may be of the same constitution or to be of different constitution, R is selected from the group consisting of alkyl, alkanol, alkyldiol, or alkytriol, said R's containing 1–8 carbon atoms, the number of hydroxyl groups furnished by the combination of said collectors being 0 to 3, the number of said hydroxyl groups in said mineral hydrocarbon complexes being 1 to 3, the sulfonium nitrites of shorter chain R's having zero hydroxyl groups, the stibine dinitrites of longer chain R's having 1–3 hydroxyl groups, said complexes attaching to bubbles provided by agitating the pulp of mineral slurry; and recovering a froth concentrate relatively rich in the desired metal value leaving tailings relatively poor in desired metal value.

2. A method according to claim 1 of beneficiating ores selected from the group consisting of oxide, silicate, sulfide, arsenide, and antimonide of copper by froth flotation process to produce a copper froth concentrate which comprises; effecting froth flotation of aforesaid ores in the presence of nitrous acid and collectors comprising a combination of ternary sulfonium nitrite and ternary stibine dinitrite, or a combination of ternary stibine dinitrite and potassium nitrite, of which R in said sulfonium radical contains 1 to 2 carbon atoms, and R in said stibine radical contains 6 to 8 carbon atoms said collectors in conjunction (combination) with nitrous acid and copper at the mineral surface forming mineral-hydrocarbon undissociable complex attaching to bubbles provided by agitating the pulp of mineral slurry; and recovering a froth concentrate relatively rich in copper metal value leaving tailings relatively poor in copper metal value.

3. A method according to claim 1, of beneficiating ores selected from the group of oxide, silicate, sulfide, arsenide, and antimonide of nickel by froth flotation process to produce a nickel froth concentrate which comprises; effecting froth flotation of aforesaid ores in the presence of nitrous acid and collectors comprising a combination of ternary sulfonium nitrite and ternary stibine dinitrite, or a combination of ternary sulfonium nitrite and calcium dinitrite, of which R in said sulfonium radical contains 1 to 2 carbon atoms, and R in said stibine radical contains 1 to 4 carbon atoms said collectors in conjunction with nitrous acid and nickel at the mineral surface forming mineral-hydrocarbon undissociable complex attaching to bubbles provided by agitating the pulp of mineral slurry; and recovering a froth concentrate relatively rich in nickel metal value leaving tailings relatively poor in nickel metal value.

4. A method according to claim 1 of benefiating ores selected from the group consisting of oxide, sulfide, arsenide, and antimonide of cobalt by froth flotation process to produce a cobalt froth concentrate which comprises; effecting froth flotation of aforesaid ores in the presence of nitrous acid and collectors comprising a combination of two different ternary sulfonium nitrites, or a combination of ternary sulfonium nitrite and potassium nitrite, of which R in one sulfonium radical contains 1 to 2 carbon atoms, and in the other sulfonium radical the number of carbon atoms in one R is from 2 to 4, said sulfonium nitrites having shorter chain R's having zero hydroxyl groups, said sulfonium nitrites having longer chain R's having 1 to 3 hydroxyl groups, said collectors in conjunction with nitrous acid and cobalt at the mineral surface forming mineral-hydrocarbon undissociable complex attaching to bubbles provided by agitating the pulp of mineral slurry; and recovering a froth concentrate relatively rich in cobalt metal value leaving tailings relatively poor in cobalt metal value.

5. A method according to claim 1 of beneficiating ores selected from the group of lithium silicates by froth flotation process to produce a lithium silicate froth concentrate which comprises; effecting froth flotation of the ore in the presence of nitrous acid and collectors comprising a combination of ternary sulfonium nitrite and ternary stibine dinitrite, or a combination of ternary stibine dinitrite and potassium nitrite, of which R in said sulfonium nitrite contains 1 to 2, carbon atoms, and R in said stibine dinitrite contains 6 to 8 carbon atoms, said collectors in conjunction with nitrous acid and lithium at the mineral surface forming mineral-hydrocarbon undissociable complex (which forms mineralized) attaching to bubbles provided by agitating the pulp of mineral slurry; and recovering a froth concentrate relatively rich in lithium silicate value leaving tailings relatively poor in lithium silicate value.

6. A method according to claim 1 of beneficiating ores selected from the group of sodium silicates by froth flotation process to produce a sodium silicate concentrate which comprises; effecting froth flotation of the ore in the presence of nitrous acid and collectors comprising a combination of ternary sulfonium nitrite and ternary stibine dinitrite, or a combination of ternary stibine dinitrite and potassium nitrite, of which R in said sulfonium nitrite contains 1 to 3 carbon atoms, and R in said stibine dinitrite contains 5 to 7 carbon atoms, said collectors in conjunction with nitrous acid (radical) and sodium at the mineral surface forming mineral-hydrocarbon undissociable complex (which forms mineralized) attaching to bubbles provided by agitating the pulp of mineral slurry; and recovering a froth concentrate relatively rich in sodium silicate value leaving tailings relatively poor in sodium silicate value.

7. A method according to claim 1 of beneficiating ores selected from the group of potassium silicates by froth flotation process to produce a potassium silicate froth concentrate which comprises; effecting froth flotation of the ore in the presence of nitrous acid and collectors comprising a combination of two different ternary stibine dinitrites, or a combination of ternary stibine dinitrite and calcium dinitrite, of which R in one stibine radical contains from 1 to 3 carbon atoms, and in the other stibine radical the number of carbon atoms in one R is 6 to 7, said stibine dinitrites having shorter chain R's having zero hydroxyl groups, said stibine dinitrites having longer chain R's having 1 to 3 hydroxyl groups, said collectors in conjunction with nitrous acid (radical) and potassium at the mineral surface forming mineral-hydrocarbon undissociable complex (which forms mineralized) attaching to bubbles provided by agitating the pulp of mineral slurry; and recovering a froth concentrate relatively rich in potassium silicate value leaving tailings relatively poor in potassium silicate value.

8. A method according to claim 1 of beneficiating ores selected from the group of potassium halides and sulfates by froth flotation process to produce a potassium halide or sulfate froth concentrate which comprises; effecting froth flotation of aforesaid ores in the presence of nitrous acid and collectors comprising a combination of ternary sulfonium nitrite and ternary stibine dinitrite, or a combination of ternary stibine dinitrite and sodium nitrite, of which R in said sulfonium nitrite contains 2 to 4 carbon atoms, and R in said ternary stibine dinitrite contains 6 to 8 carbon atoms said collectors in conjunction with nitrous acid and potassium at the mineral surface of potassium halides or sulfates forming mineral-hydrocarbon undissociable complex (which forms mineralized) attaching to bubbles provided by agitating the pulp of mineral slurry; and recovering a froth concentrate relatively rich in potassium halide or sulfate value leaving tailings relatively poor in potassium halide or sulfate value.

9. A method according to claim 1 of beneficiating ores selected from the group of caesium silicates by froth flotation process to produce a caesium silicate froth concentrate which comprises; effecting froth flotation of the ore in the presence of nitrous acid and collectors comprising a combination of two different ternary stibine dinitrites or a combination of ternary stibine dinitrite and barium dinitrite, of which R in one stibine radical contains from 2 to 4 carbon atoms, and in the other stibine radical the number of carbon atoms in one R is 6 to 7, said stibine dinitrites having R's of shorter chain length having zero hydoxyl groups, said stibine dinitrites having R's of longer chain length having 1 to 3 hydroxy groups; said collectors in conjunction with nitrous acid and caesium at the mineral surface forming mineral-hydrocarbon undissociable complex (which forms mineralized) attaching to bubbles provided by agitating the pulp of mineral slurry; and recovering a froth concentrate relatively rich in caesium silicate value of leaving tailings relatively poor in caesium silicate value.

10. A method according to claim 1 of beneficiating ores selected from the group of strontium sulfate and carbonate minerals by froth flotation process to produce a strontium sulfate or carbonate froth concentrate which comprises; effecting froth flotation of the ore in the presence of nitrous acid and collectors comprising a combination of ternary sulfonium nitrite and ternary stibine dinitrite, or a combination of ternary stibine dinitrite and potassium nitrite, or a combination of ternary sulfonium nitrite and iron dinitrite which is introduced as ferrous sulfate in combination with barium dinitrite, R in said sulfonium nitrite contains from 1 to 3 carbon atoms, said collectors in conjunction with nitrous acid and strontium at the mineral surface forming mineral-hydrocarbon undissociable complex attaching to bubbles provided by agitating the pulp of mineral slurry; and recovering a froth concentrate relatively rich in strontium sulfate or carbonate value leaving tailings relatively poor in strontium sulfate or carbonate value.

11. A method according to claim 1 of beneficiating ores selected from the group of barium sulfate or carbonate minerals by froth flotation process to produce a barium sulfate or carbonate froth concentrate which comprises; effecting froth flotation of the ore in the presence of nitrous acid and collectors comprising a combination of ternary sulfonium nitrite and ternary stibine dinitrite, or a combination od ternary stibine dinitrite and iron dinitrite which is introduced as ferrous sulfate in combination with barium dinitrite, R in said sulfonium nitrite contains 1 to 2 carbon atoms, and R in said ternary stibine dinitrite contains 6 to 8 carbon atoms, said collectors in conjunction with nitrous acid and barium at the mineral surface forming mineral-hydrocarbon undissociable complex attaching to bubbles provided by agitating the pulp of mineral slurry; and recovering a froth concentrate relatively rich in barium sulfate or carbonate value leaving tailings relatively poor in barium sulfate or carbonate value.

* * * * *